US005813585A

United States Patent [19]

Kannankeril et al.

[11] Patent Number: 5,813,585

[45] Date of Patent: Sep. 29, 1998

[54] DISPENSER FOR PLASTIC BAGS

[75] Inventors: Charles P. Kannankeril, North Caldwell, N.J.; Bruce A. Cruikshank, Wilton, Conn.; German Gavronsky, Stamford, Conn.; Brian K. Farison, New Milford, Conn.

[73] Assignee: Sealed Air Corporation, Saddle Brook, N.J.

[21] Appl. No.: 827,630

[22] Filed: Apr. 10, 1997

Related U.S. Application Data

[63] Continuation of Ser. No. 298,203, Aug. 29, 1994, abandoned, which is a continuation-in-part of Ser. No. 175,292, Dec. 29, 1993, Pat. No. 5,573,168.

[51] Int. Cl.[6] ..... B26F 3/02

[52] U.S. Cl. ..... 225/106; 225/46; 225/79; 225/80; 225/90

[58] Field of Search ..... 225/106, 41, 42, 225/46, 49, 51, 76, 79, 80, 82, 90

[56] References Cited

U.S. PATENT DOCUMENTS

| | | | |
|---|---|---|---|
| 1,122,673 | 12/1914 | Winter et al. | 225/106 |
| 2,349,635 | 5/1944 | Pusheck | 225/85 |
| 2,477,014 | 7/1949 | Stanley et al. | 248/223.41 |
| 2,597,602 | 5/1952 | Sipior | 225/19 |
| 2,850,157 | 9/1958 | Klein et al. | 225/51 X |
| 3,045,883 | 7/1962 | Andrews et al. | 225/90 |
| 3,050,224 | 8/1962 | Drolshammer | 225/38 |
| 3,098,594 | 7/1963 | Williamson | 225/48 |
| 3,229,876 | 1/1966 | Osborn, Jr. | 225/49 |
| 3,510,033 | 5/1970 | Schramm et al. | 225/77 |
| 3,982,659 | 9/1976 | Ross | 221/63 |
| 4,271,962 | 6/1981 | Stepanski | 225/51 X |
| 4,289,262 | 9/1981 | Finkelstein | 225/106 |
| 4,383,657 | 5/1983 | Suh | 225/46 X |
| 4,424,926 | 1/1984 | Gatward | 225/42 X |
| 4,714,191 | 12/1987 | Richardson | 229/121 |
| 4,793,539 | 12/1988 | Haenni et al. | 225/106 |
| 4,919,350 | 4/1990 | Miller | 225/51 X |
| 5,024,349 | 6/1991 | Haenni et al. | 221/46 |
| 5,111,985 | 5/1992 | Lapeyre | 225/91 |
| 5,118,022 | 6/1992 | Farahnik | 225/106 |
| 5,135,134 | 8/1992 | Dancy | 221/61 |
| 5,135,146 | 8/1992 | Simhaee | 225/80 |
| 5,170,957 | 12/1992 | Carpenter | 242/55.53 |
| 5,207,368 | 5/1993 | Wilfong, Jr. et al. | 225/106 |
| 5,219,424 | 6/1993 | Simhaee | 225/47 |
| 5,261,585 | 11/1993 | Simhaee | 225/79 X |
| 5,425,486 | 6/1995 | Kurker | 225/46 |
| 5,573,168 | 11/1996 | Kannankeril et al. | 225/106 |

FOREIGN PATENT DOCUMENTS

| | | | |
|---|---|---|---|
| 413664 | 8/1910 | France | 225/80 |
| 398106 | 9/1933 | United Kingdom . | |
| 587290 | 4/1947 | United Kingdom . | |
| 2 088 330 | 6/1982 | United Kingdom . | |
| 2088330 | 6/1982 | United Kingdom . | |

*Primary Examiner*—Maurina T. Rachuba
*Attorney, Agent, or Firm*—Bell Seltzer Intellectual Property Group of Alston & Bird LLP

[57] ABSTRACT

A dispensing apparatus for serially dispensing plastic bags from a wound roll of continuous flexible plastic bags joined along perforated severance lines. A container is provided which is adapted to receive the wound roll of plastic bags. The container has a bottom, a pair of opposed sides having an inwardly facing flange extending therefrom, and a separating tongue projecting outward from the bottom. The flanges define a self-threading slide for threading the plastic bags from the wound roll along a predetermined path onto the separating tongue. The separating tongue separates the plastic bags from the wound roll as the plastic bags engage the separation tongue along a predetermined path of travel. A mounting bracket cooperates with the bottom to mount the container to a solid surface in a plurality of different positions while maintaining the desired orientation of the container, to ensure that the wound roll is biased against the bottom and the flanges for self-braking of the wound roll and for limiting overspinning thereof as plastic bags are serially separated therefrom.

13 Claims, 5 Drawing Sheets

DISPENSER FOR PLASTIC BAGS

CROSS-REFERENCE TO RELATED APPLICATION

This application is a continuation of copending application Ser. No. 08/298,203, filed Aug. 29, 1994, now abandoned, which is a continuation-in-part of application Ser. No. 08/175,292, filed Dec. 29, 1993, now U.S. Pat. No. 5,573,168, issued Nov. 12, 1996.

FIELD OF THE INVENTION

The present invention relates to a dispensing apparatus adapted for serially dispensing plastic bags from wound rolls which are joined long perforated severance lines.

BACKGROUND OF THE INVENTION

Supermarkets or food markets are currently displaying fruits and vegetables in bulk, enabling customers to inspect the quality o the fruits and vegetables and individually select the desired items. The fruits and vegetables are displayed in their original shipping containers, loosely arranged in display bins or, when appropriate, stacked into piles.

Plastic produce bags are usually provided to hold the selected fruits and vegetables. Normally, the plastic bags are cylindrically wound rolls which are placed in dispensers for use by customers. The bags on the wound rolls are separated by perorated severance lines which allow the plastic bags to be serially dispensed from the wound roll. However, because of the nature of the displays used for the fruits and vegetables and the nature of existing bag dispensers, it is difficult to attach the plastic bag dispensers in a convenient location. The wound roll of plastic bags is often merely placed on a fixed shaft which has one end thereof mounted on a stand attached to a solid surface and positioned either horizontally or vertically on a solid surface.

To take a bag from the wound roll on such a bag dispenser, requires the customers to grab the end bag with one hand while holding the next bag and/or the wound roll with the other and then pull with sufficient force to separate the end bag from the wound roll along the severance line. In so doing, the customer often not only separates the end bag from the wound roll, but also deforms or tears the end bag depending upon the amount of force used.

The customer occasionally has one hand occupied holding the selected fruits or vegetables or some other item which precludes using both hands to separate the end bag from the wound roll. When this happens, the customer usually attempts to jerk the bag from the wound roll without holding the adjacent bag and/or the wound roll. This usually results in damage to the end bag and/or causes the wound roll to over spin on the fixed shaft. This free spinning of the wound roll about the fixed shaft causes an excessive number of bags to be reeled from the wound roll. These unwanted bags must then be either rewound onto the wound roll or separated therefrom resulting in possible damage and/or waste. Furthermore, after the end bag has been removed from the wound roll, it may be difficult to find the next bag because the next bag will likely lie flush against the wound roll.

The purpose of providing produce bags adjacent the fruits and vegetables in the produce department is to assist customers with packaging of the selected items. To properly assist customers it is helpful to provide a plastic bag dispenser which is both conveniently positioned and properly oriented to allow only one bag to be dispensed at a time.

One approach to serially dispensing plastic bags may be seen in U.S. Pat. No. 5,219,424 and related U.S. Pat. No. 5,135,146 to Simhaee which disclose a dispenser having a tongue which engages the separation line between the bag at the end of the wound roll and the next bag. A finger is provided on the upstream side of the tongue with a gap being formed between the finger and the tongue such that as the bag is separated, a portion of the front edge of the next bag is held in the gap, thereby holding the bag in position for the next user. However, in this configuration, there is no provision for quick self-threading of a wound roll and ensuring that the plastic bag is threaded from the wound roll onto the separating tongue, thereby ensuring contact of the severance line with the tongue for separation of the end bag from the wound roll along the severance line.

A further limitation of existing bag dispensers is their inability to by mounted to a solid surface adjacent the display while maintaining the desired orientation of the dispenser for easy removal of the bags. The ability to mount a plastic bag dispenser in a wide number of different positions, conveniently located adjacent to the fruits and vegetables, while maintaining the desired orientation is very desirable.

SUMMARY OF THE INVENTION

In view of the foregoing background, it is therefore an object of the present invention to provide an improved dispensing apparatus for serially dispensing plastic bags which is capable of being mounted to a solid surface in a plurality of positions while maintaining a desired orientation.

This object and other objects, features and advantages of the present invention are obtained by providing a dispensing apparatus for serially dispensing flexible plastic bags from a wound roll of continuous bags joined along perforated severance lines. A container is provided to receive the wound roll of plastic bags. The container preferably includes a bottom and a pair of opposed sides which extend upward therefrom.

A separating means is preferably located on the container to engage the severance line of the plastic bags and separate the end plastic bag from the next bag on the wound roll to provide for serial dispensing of the plastic bags.

A self-threading means is preferably located on or attached to the container for threading the plastic bags from the wound roll received in the container onto the separating means. The self-threading means provides for easy threading of a new or replacement wound roll onto the separating means. Preferably, the self-threading means comprises a pair of inwardly facing flanges which extend generally transverse to the pair of sides and which are laterally spaced apart to define an opening through which are directed the advancing plastic bags to allow for easy dispensing thereof.

In the preferred embodiment, the separating means comprises a separating tongue which extends outward from the bottom and is shaped so as to engage the severance line located between the plastic bags. The separating tongue of the separating means is preferably located slightly above horizontal axial alignment with the bottom to ensure that the separating tongue easily contacts the severance line of the plastic bags at the desired location.

The container in its preferred embodiment includes a mounting means which allows the container to be mounted in a wide variety of positions on a wide variety of solid surfaces while maintaining the container in its desired orientation. This ability of the mounting means to be mounted on any number of solid surfaces allows for the device to be attached to displays, counters, refrigeration units, etc., throughout a store or other establishment.

It is desirable to have the container be formed in a unitary construction to simplify the production and improve the strength of the container. It is also beneficial to have portions of the bottom and the sides be cut away to provide easy access to the wound roll for purposes of replacement, reduce the overall weight of the device, and limit the build up of any debris within the container. In the unlikely event that the end of the wound roll is not retained by the separating means, the cut always allow easy rethreading of the wound roll. The shape and location of the cut aways, in cooperation with the container, provide clear visual access to approximately eighty percent of the wound roll. Therefore, locating the end of the wound roll for rethreading is greatly simplified.

The preferred orientation of the container is such that the wound roll is biased against the bottom and the pair of flanges to improve the self-braking of the wound roll and limit overspinning thereof as the plastic bags are serially separated from the wound roll. To assist in the biasing of the wound roll against the bottom and the pair of flanges, it is preferable to have the separating means be angled downward away from the bottom. This becomes more important as the wound roll becomes smaller in diameter as the bags are removed therefrom. Continuously biasing the wound roll against the flanges and the bottom creates a pinching effect, preventing the wound roll from overspinning as the bags advance toward the separating means. In addition, it also helps to retain the wound roll within the container. This self-braking arrangement of the container minimizes the inconvenience and waste associated with the excess bags caused by overspin of the wound roll. To assist in this function, it is possible to coat the bottom and a bottom portion of the sides and flanges with a high friction material, such as rubber, to create friction and improve the braking of the wound roll as it gets smaller. It is also possible to coat the upper portion of the sides and flanges with smooth materials, for example polytetrafluoroethylene such as that marketed under the trademark TEFLON®, to prevent increased friction created by a new wound roll which is both relatively large and heavy.

In the preferred embodiment, the bracket has a first end, a second end and a center portion extending therebetween. Its is beneficial to have the first end be bent at an angle approaching 90° relative to the center portion while having the second end be bent at an angle approaching 45° relative to the center portion. It is also beneficial to have the bent first end and second end project away from the center portion on opposite sides of the longitudinal axis thereof. Such a configuration of the bracken enables the container to be mounted in a plurality of positions while maintaining the desired orientation of the container.

It is desirable to provide the first end of the bracket with a first bracket aperture, the second end with a second bracket aperture, and the center portion with a third bracket aperture. One of these first, second, and third bracket apertures will preferably cooperate with a bottom aperture, defined in the bottom, and a conventional fastener to thereby attach the bracket to the container. The other end of the bracket is mounted by means of a conventional fastener to the desired solid surface. The center portion ideally has the third bracket aperture located adjacent the first end to increase the number of positions in which the container can be mounted.

BRIEF DESCRIPTION OF DRAWINGS

Some of the objects and advantages of the present invention having been stated others will appear as the description proceeds, when taken in conjunction with the accompanying drawings, in which.

DESCRIPTION OF THE ILLUSTRATED EMBODIMENT

The present invention will now be described more fully hereinafter with reference to the accompanying drawings, in which the preferred embodiment of the invention is shown. This invention may, however, be embodied in many different forms and should not be construed as limited to the embodiments set forth herein. Rather, the illustrated embodiment is provided so that this disclosure will be thorough and complete, and will fully convey the scope of the invention to those skilled in the art. Like numbers refer to like elements throughout.

Figure 1:
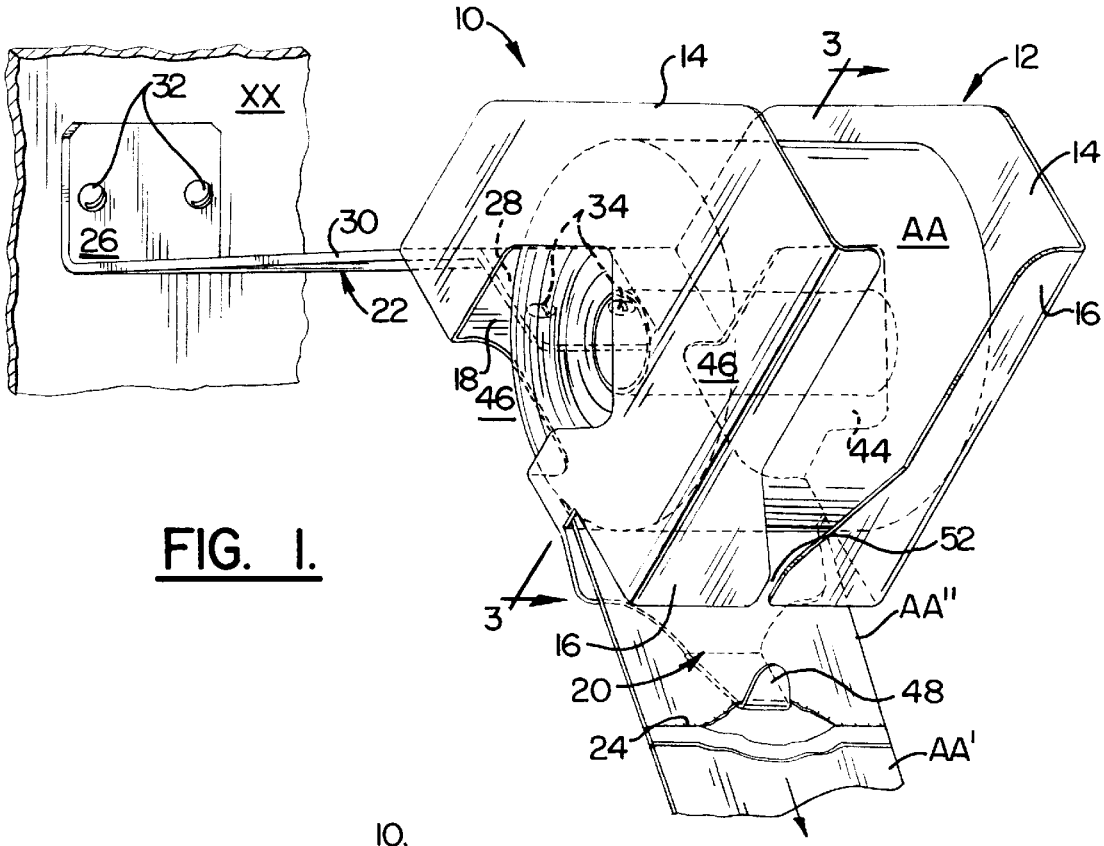
FIG. 1 is a perspective view of a dispensing apparatus for bags in accordance with the present invention.
Figure 2:
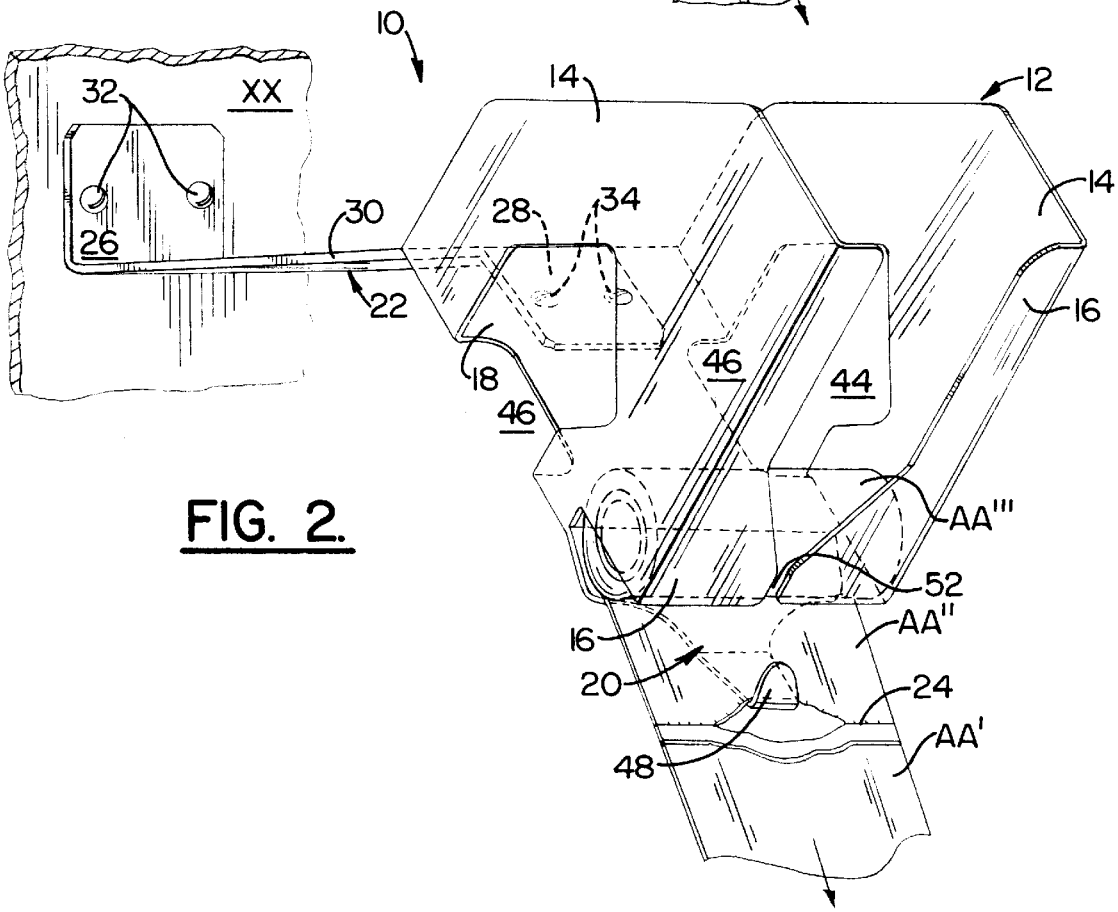
FIG. 2 is a view similar to that of FIG. 1 showing the wound roll with only a few bags remaining thereon.

Referring to FIGS. 1 and 2, the apparatus of the present invention is illustrates generally at 10. The apparatus 10 includes a container, generally indicated at 12 and a mounting bracket, generally indicated at 22.

The container 12 has a unitary construction formed from a pair of opposed sides 14, a pair of flanges 16 extending generally transverse to the sides, a bottom 18 positioned below the sides, providing support therefor and a separating means or tongue 20 extending outwardly from the bottom 18. The container 12 is adapted to receive a wound roll of plastic bags AA, which is formed of a continuous roll of flexible bags AA, such as plastic, joined along perforated severance lines 24. The plastic bags AA are intended for use as produce bags in supermarkets or food markets, for carrying fruit and/or vegetables. It is to be understood however, that the apparatus 10 may be utilized for dispensing any number of different types of bags AA, which may be used for any particular use while remaining within the spirit of the invention. It is important that the bags which are chosen to be used in accordance with this invention are sufficiently flexible so as to be packaged on a wound roll.

The container 12 of this embodiment has a very open configuration, relying on the cooperation between the bottom 18, the sides 14, the flanges 16, and the orientation of the container (see FIGS. 6–11), as determined by the mounting bracket 22, to retain the wound roll within the container. The size of the container 12 corresponds to the wound roll of plastic bags AA to be received. The container 12 shown in FIGS. 1–11 has a solid construction, to the extent that the sides 14, the flanges 16 and the bottom 18 are formed of solid panels. It is to by understood, however, that the container 12 may also have a very open construction and remain within the spirit of the invention. Almost any material can be used for the container 12 so long as the container 12 is capable of retaining a wound roll AA and cooperating with the mounting bracket 22. For example, rather than the solid construction shown, the container 12 may be constructed of wire or mesh.

As may be best seen in FIGS. 1, 2 and 6–11, the mounting bracket 22 mounts the container 12 to a surface XX, preferably solid, in any one of a plurality of different positions. The mounting bracket 22 has a first end 26, a second end 28, and a center portion 30. The first end 26 is bent at an angle of approximately 90° from the longitudinal axis of the bracket 22. The second end 28 is bent at an angle of approximately 45° from the longitudinal axis of the b racket 22. The first end 26 and the second end 28 of the bracket 22 are bent in opposite directions from the longitudinal axis of the bracket. This opposed relationship of the first end 26 and the second end 28 relative to the center portion 30 of the bracket 22, allows the container 12 to be mounted in a wide variety of positions, while maintaining the desired orientation. The desired orientation of the container 22 will be described in detail below. The bracket 22 defines a first bracket aperture 32 located at the first end 26, a second bracket aperture 34 located at the second end 28 and a third aperture 36 located adjacent the first end.

The bottom 18 of the container 12 has a bottom aperture 38 which selectively cooperates with one of the first, second or third bracket apertures (32, 34 and 36, respectively) by means of a conventional fastener, such as the nut(s) and bolt(s) 40 shown in FIGS. 1–3 and 6–11. A second set of fasteners 42 is used to mount the bracket to the solid surface XX. It is to be understood that other types of fasteners may be used to mount or secure the bracket 22 to the solid surface XX and/or the container 12 and remain within the spirit of this invention.

As best shown in FIGS. 6–11, the desired orientation of the container 12 is such that the wound roll, regardless of its size (see AA'" in FIG. 2 for a small wound roll caused by having only a few bags remaining thereon) is biased against the flanges 16 and the bottom 18. Preferably, the container 12 is oriented approximately 45° from horizontal. In this orientation, the juncture of the bottom 16 and the opposed sides 14, which are joined at an angle approaching 90°, form the lower most point of the container 12. It is the combination of this orientation of the container 12 and the connection of the bottom 18 and the sides 14 which encourages self-braking of the wound roll and disco rages or limits the wound roll from overspinning or moving away from the flanges 16 and the bottom 18 as the wound roll unwinds due to advancement of the plastic bags AA out of the container 12. The bottom 18 is in lined when the container is in the desired orientation. In practice, the orientation of the container 12 and the configuration of the flanges 16 and the downward orientation of the separating means 20 creates a pinching effect on the wound roll to prevent it from overspinning regardless of the size of the roll. To assist in braking or preventing overspinning and retention of the wound roll, it impossible to treat the bottom 18 and/or the portions If the sides 14 and/or the flanges 16 adjacent the bottom with a high frictional coating, such as rubber To decrease the initial friction when a new wound roll is placed in the container 12, it is possible to coat the portions of the sides 14 and/or the flanges 16 distal to the bottom 18 with a smooth, low friction material, such as TEFLON® to increase the ease of dispensing the first few bags from the wound roll. The eight of the wound roll AA itself also helps, at least initially, with preventing overspin. As the size of the wound roll decreases, the weight of the wound roll becomes less of a factor in preventing overspinning.

As illustrated in FIGS. 3 and 6–11, each of the pair of opposed sides 14 has a generally square shape which cooperates with the bottom 18, to retain the wound roll. A corner of the square shape of each sides 14, remote from the flanges 11, has been cut at an extended 45° angle to reduce the weight of the container 12. In addition, first cutouts 44 are defined in each of the sides 14 to so reduce the weight of the container 12 and to provide easy access to the wound roll. These cutouts 44 assist in the ease of replacing wound rolls to be received within the container 12. The sides 14 are also provided to limit lateral movement of the wound roll as it is unwound. The sides extend a sufficient distance upward from the bottom 18 to contain the wound roll The bottom 18 has corresponding second cutouts 46, which are contiguous with the first cutouts 44, to also reduce the overall weight of the container 12 and prevent any foreign objects from collecting inside the container. The first cutouts 44, the second cutouts 46, the opening between flanges 16 and the open top of the container 12 provide ease visual access to approximately 80% of the wound roll. The visual access allows an individual to quickly locate the end bag AA', if it is not retained on the separating means 20, for purposes of rethreading the end bag. In the present embodiment, the cutouts 46 are generally rectangular. It is to be understood however, that the cutouts 46 may take any shape desired so long as the above-referenced objectives are met.

The separating means 20, illustrated in FIGS. 1–3 and 6–11, initially extends downward from the bottom 18 at an angle approaching 45°. The purpose of this downward configuration (best seen in FIGS. 2 and 3) is to continuously bias or pinch the wound roll against the flanges 16 and the bottom 18, especially when the wound roll is small. The reduced weight of the smaller wound roll would otherwise either overspin and/or travel up the inclined bottom 18, as the end bag AA' is removed from the wound roll. The separating means 20 then inclines slightly and forms at its free end a hook 48, to engage the severance line 24 between the end bag AA' and the next bag AA" to allow the end bag to be separated from the wound roll. The hook 48 is positioned slightly above the horizontal plane of the bottom 18 to ensure easy engagement with the severance line 24 between the plastic bags AA. It is to be understood that the separating means 20 and its associated hook 48 may take on other related shapes and orientations, so long as the separating means easily engages the severance line between plastic bags AA.

Figure 4:
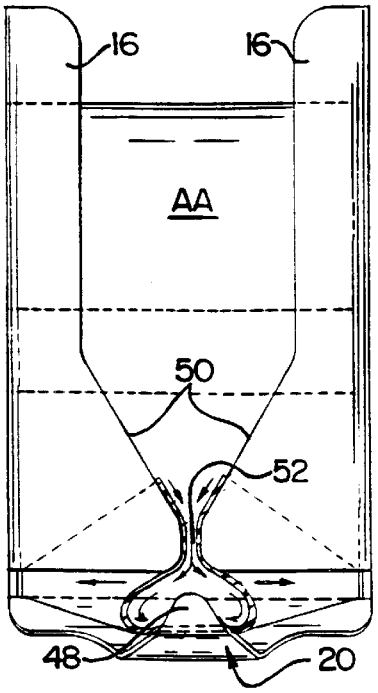
FIG. 4 is an end view showing a plastic bag being fed along a threading slide in accordance with the present invention.
Figure 5:
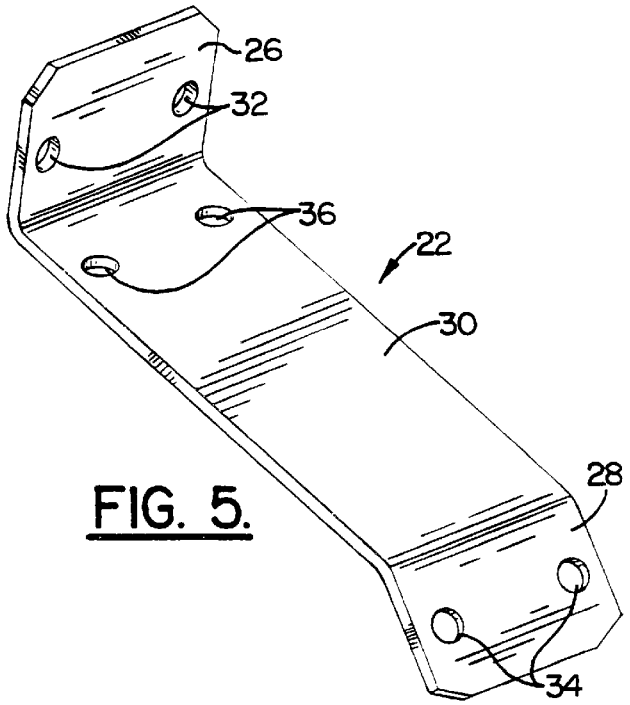
FIG. 5 is a perspective view of the mounting bracket in accordance with the present invention.
Figure 6:
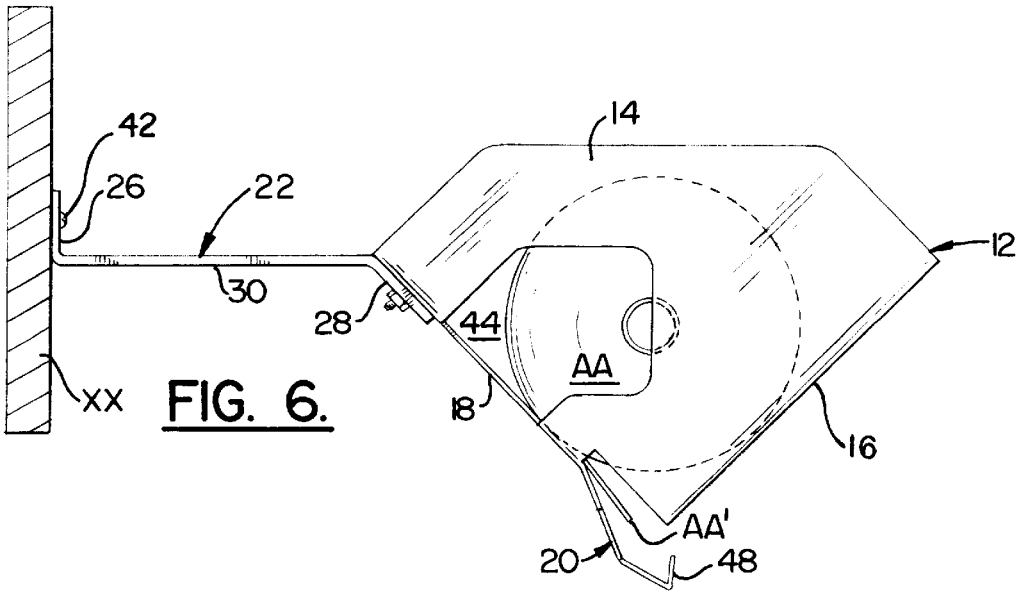
FIGS. 6–11 are a series of cross-sectional views showing the cooperation between the mounting bracket and the container for mounting the container to a solid surface in a plurality of positions.
Figure 7:
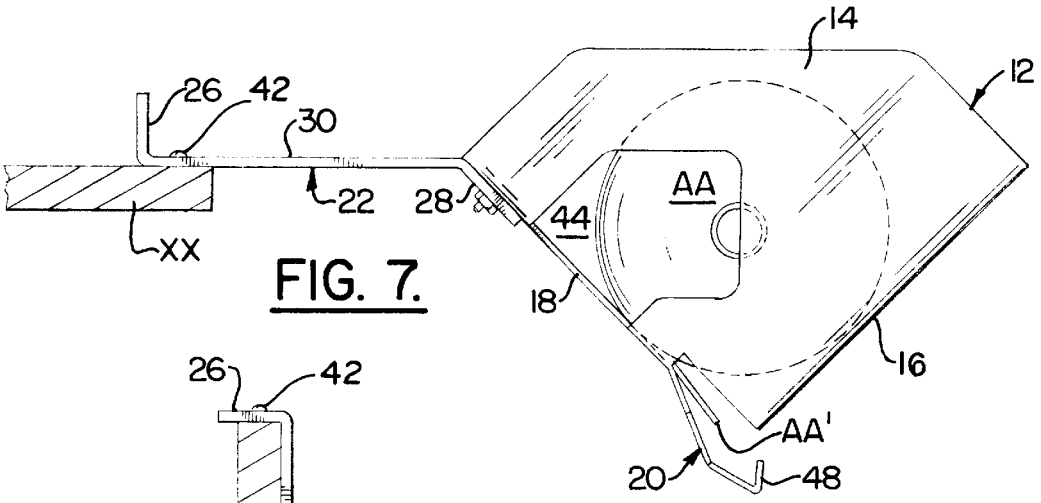
Figure 8:
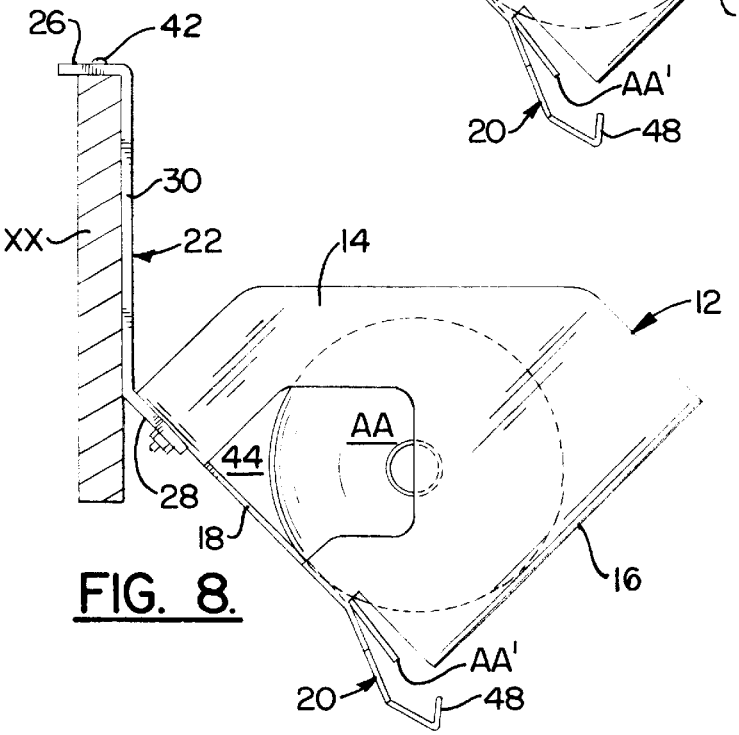
Figure 9:
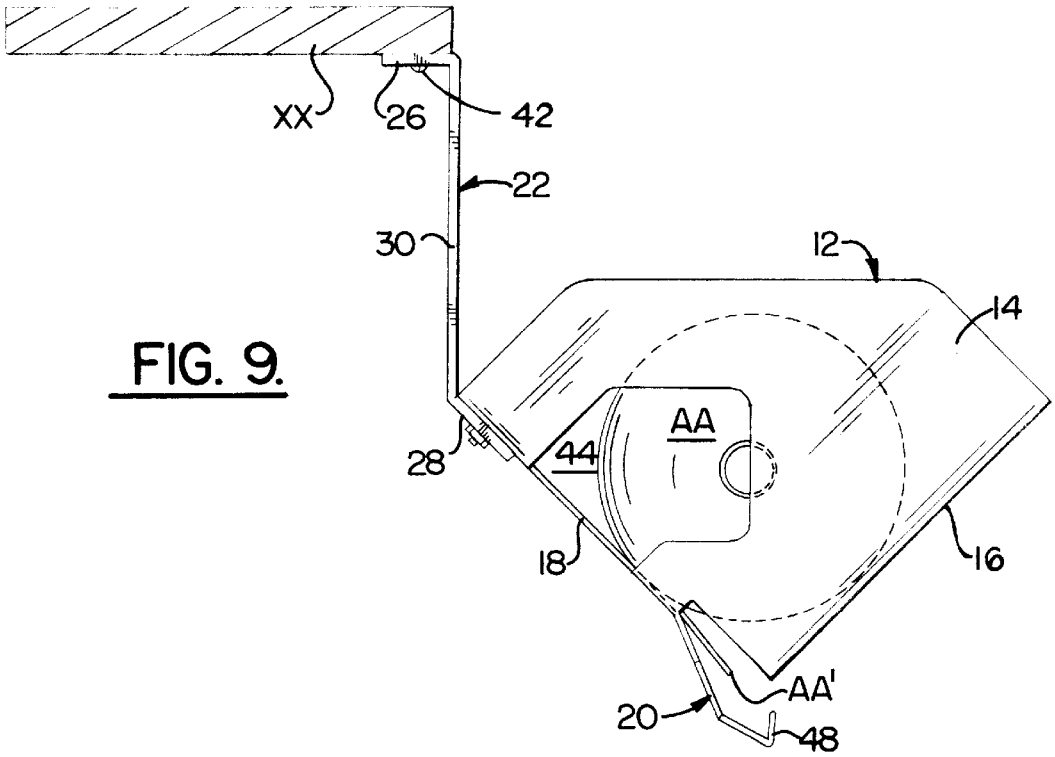
Figure 10:
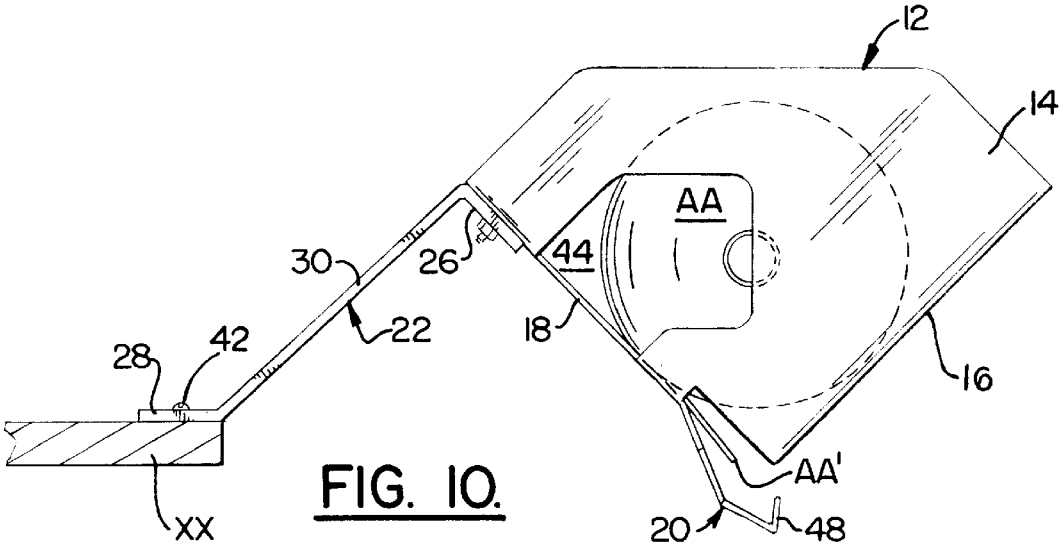
Figure 11:
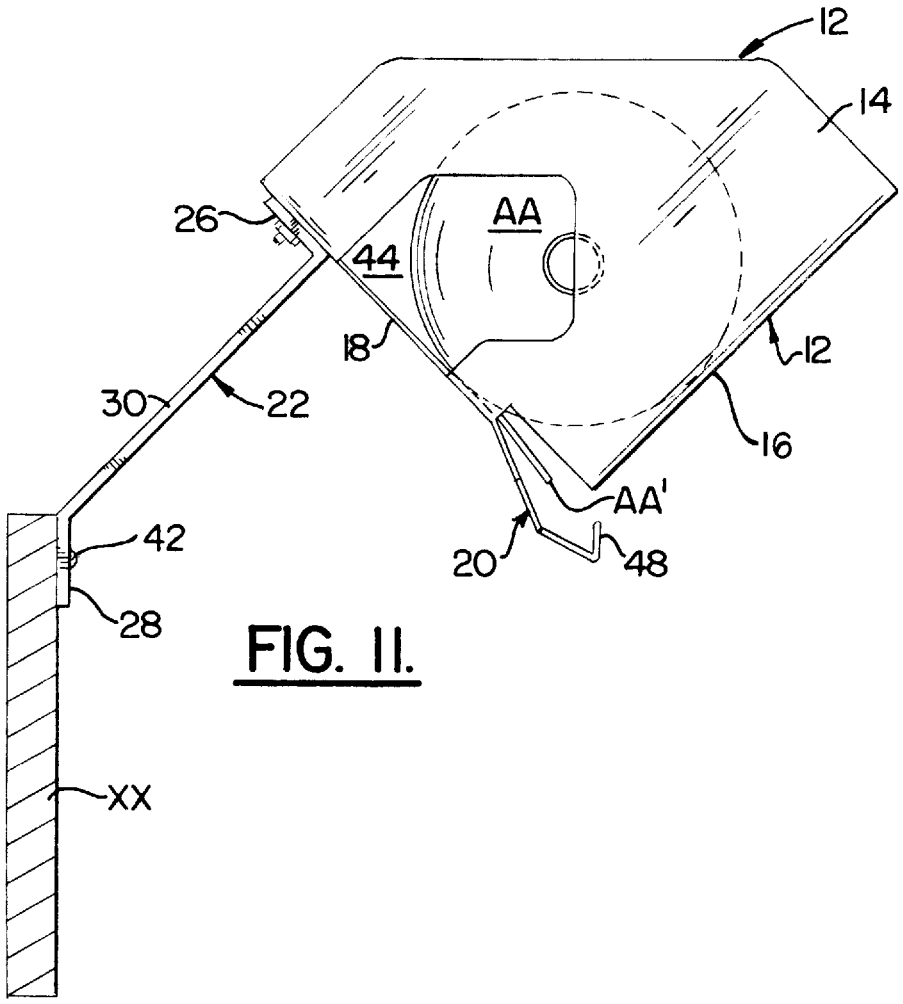

As illustrated in FIGS. 1 2 and 4, the flanges 16 combine to form a generally rectangular configuration. The adjacent surface of each flange 16 is cut at an angle to form a self-threading slide 50 therebetween. The two flanges 16 are spaced apart a sufficient distance so as to form an opening 52 therebetween, which is contiguous with the separating means 20. Rather than having pointed edges of the opening 52, edges are rounded, to allow the advancing plastic bags AA to easily pass through the opening without damaging or obstructing travel of the bags.

In operation, the wound roll is inserted such that the plastic bags AA unwind from the bottom of the wound roll. The wound roll of this embodiment does not need to be mounted on an axle. Rather, the wound roll is simply placed within the container and allowed to rotate freely. If desired, an axle may be provided within the container 12, to rotationally support the wound roll. It is also possible to place the wound roll within the container so that the plastic bags AA unwind from the top of the wound roll.

As shown in the preferred embodiment in FIG. 4, the end bag AA' is pulled upward from the bottom of the wound roll toward the flanges 16 along the threading slide 50. As the end bag AA' is pulled generally horizontally along the self-threading slide 50, the end bag slides down the self-threading slide, all the while beginning to fold into itself, so as to have a generally U-shaped configuration as may be seen in FIG. 4. As the end bag AA' is continued to be pulled horizontally, the bag will slide around the rounded edges of the self-threading slide 50, passed the opening 52 and onto the separating means 20, as shown in FIGS. 1, 2 and 4. As the end bag AA' advances on its predetermined path toward the hook 48, the bag will unfold along the separating means 20.

Figure 3:
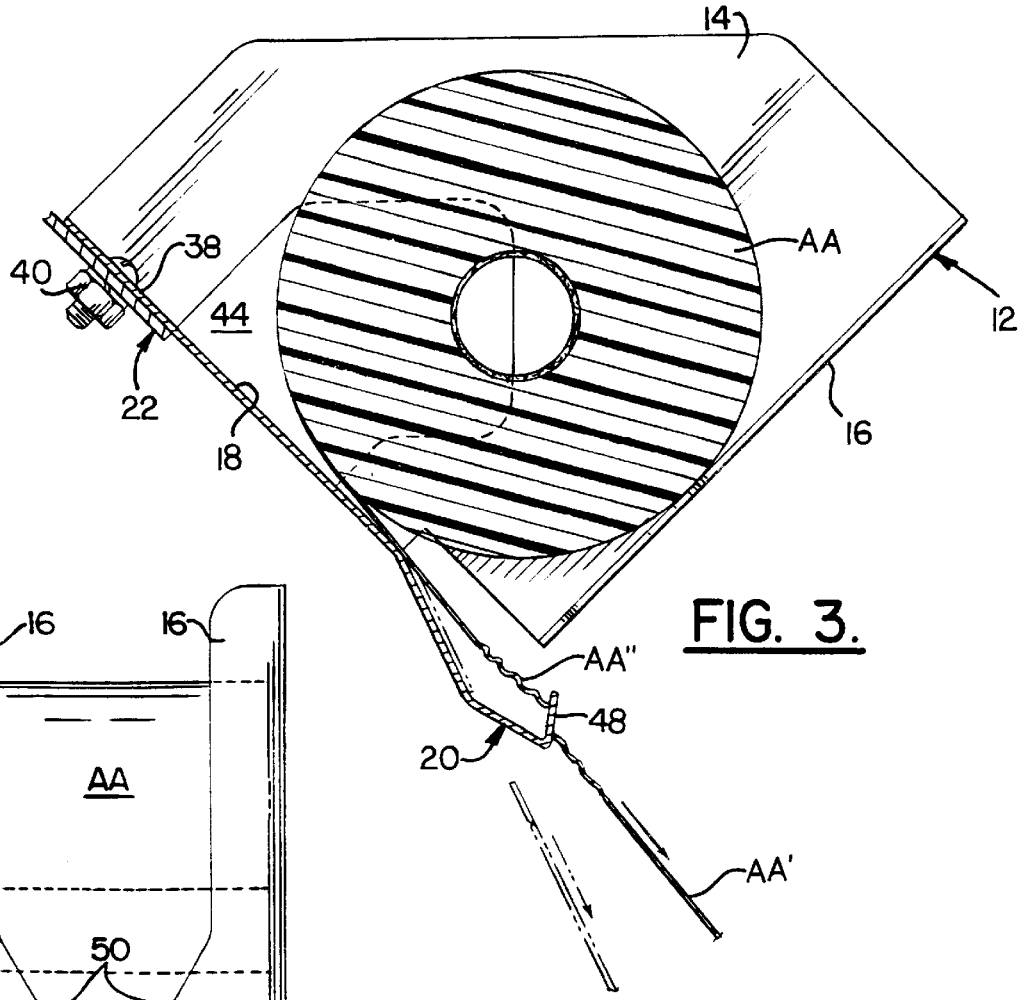
FIG. 3 is a cross-sectional view taken along line 3—3 of FIG. 1.

To remove the end bag AA' from the container 12, an individual or customer grabs the end bag with one hand and pulls the bag in a generally horizontal fashion away from the container 12. As shown in FIG. 3, the end bag continues to be pulled along its predetermined direction of travel, so that the perforated severance line 24 between the end bag AA' and the next bag AA", will line up and engage the hook 48. This will ensure that the end bag Will easily separate from the wound roll, while advancing the next bag AA" a sufficient distance beyond the container 12 to allow for its easy withdrawal. In this embodiment, the plastic bags AA may be removed from the container 12 and separated from the wound roll with the use of only one hand, while ensuring that the next bag AA" can be easily grasped for removal.

In an alternative embodiment, rather than treat the container, as previously described, with a rubberized material, the bottom 18 and/or the sides 14 and/or the flanges 16, may be treated with other materials or provided with a textured surface to achieve the desired frictional surface.

Many modifications and other embodiments of the invention will come to mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A dispensing apparatus or serially dispensing plastic bags from a wound roll of continuous flexible plastic bags joined along perforated severance lines, said dispensing apparatus comprising:

a container for receiving the wound roll of plastic bags, said container including a generally planar bottom, a pair of opposed sides extending upwardly from said bottom and a pair of inwardly facing generally planar flanges carried by and extending generally transversely of said sides and generally perpendicular to said bottom, said bottom, sides and flanges defining a dispensing opening for the plastic bags;

a separating tongue located on said container adjacent said dispensing opening for engaging a severance line of the plastic bags and separating the plastic bags from the wound roll;

self-threading means for threading an end bag from the wound roll received in said container onto said separating tongue, and said self-threading means comprising an upwardly opening and upwardly widening space between said flanges for receipt of an end bag of a wound roll upon insertion of the roll into the container and defining a predetermined guide path for the end bag downwardly into the dispensing opening; and a mounting bracket having a first end for mounting said container to a solid surface and a second end for attaching to said container, so as to mount said container in a desired orientation for biasing the wound roll against said self-threading means and said bottom for self-braking of the wound roll and for reducing overspinning thereof as plastic bags are serially separated therefrom.

2. An apparatus according to claim 1 wherein said separating tongue projects outwardly from said bottom for engaging the severance line between adjacent plastic bags for separating the plastic bag from the wound roll.

3. An apparatus according to claim 1 wherein said sides each define a cutout for reducing overall weight of said container.

4. An apparatus according to claim 1 wherein said bottom defines a cutout for reducing weight of said container, preventing waste objects from accumulating in said container and providing visual access to a majority of the wound roll for locating an end bag of the wound roll.

5. An apparatus according to claim 1 wherein said container comprises a unitary construction having said bottom and said pair of opposed sides form opposed surfaces joined at an angle of approximately 90°.

6. An apparatus according to claim 1 wherein portions of said bottom and said flanges adjacent said dispensing opening comprise high friction surfaces to reduce overspin of the wound roll.

7. An apparatus according to claim 1 wherein at least one of said bottom, sides and flanges include low friction surfaces spaced above said dispensing opening to overcome initial friction of the wound roll.

8. A dispensing apparatus for serially dispensing bags from a wound roll of continuous bags joined along perforated severance lines, said dispensing apparatus comprising:

a container adapted to receive the wound roll of bags therein, said container having a generally planar bottom, a pair of opposed sides extending therefrom and a pair of inwardly facing generally planar flanges extending generally transverse to said pair of sides and generally perpendicular to said bottom, said bottom, sides and flanges defining a dispensing opening for the bags;

a separating tongue projecting outwardly from said bottom for separating an end bag traveling along a predetermined path from said dispensing opening from an adjacent bag along a severance line located therebetween;

self-threading means formed by said pair of inwardly facing flanges for receiving an end bag of the wound roll upon placement thereof in said container and guiding the end bag into said dispensing opening and onto said separating tongue; and a mounting bracket having a first end for mounting said container to a solid surface and a second end for attaching to said container, so as to mount said container to a solid surface in a desired orientation so as to bias the wound roll against said flanges and said bottom for self-braking of the wound roll and for reducing overspin thereof as plastic bags are serially separated therefrom.

9. An apparatus according to claim 8 wherein said pair of opposed sides each define a cutout for reducing overall weight of said container.

10. An apparatus according to claim 8 wherein said bottom defines a cutout for reducing weight of said container, preventing waste objects from accumulating in said container and for providing visual access to a majority of the wound roll for locating an end of the wound roll.

11. An apparatus according to claim 8 wherein said container comprises a unitary construction.

12. An apparatus according to claim 8 wherein said bottom of said container is oriented generally 45° from a generally horizontal plane.

13. An apparatus according to claim 8 wherein said pair of opposed sides and said flanges are joined at an angle of approximately 90°.

* * * * *